US011746959B2

(12) United States Patent
Bellingeri et al.

(10) Patent No.: US 11,746,959 B2
(45) Date of Patent: Sep. 5, 2023

(54) GAS CONTAINER WITH DISPLAY OF THE FLOW AND OF THE CORRESPONDING AUTONOMY

(71) Applicant: L'Air Liquide, Société Anonyme pour l'Etude et l'Exploitation des Procédés Georges Claude, Paris (FR)

(72) Inventors: Federica Bellingeri, Paris (FR); Adrien Campagnac, Paris (FR); Alexis Mary, Boulogne-Billancourt (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 80 days.

(21) Appl. No.: 17/147,647

(22) Filed: Jan. 13, 2021

(65) Prior Publication Data

US 2021/0215300 A1 Jul. 15, 2021

(30) Foreign Application Priority Data

Jan. 14, 2020 (FR) ..... 2000287

(51) Int. Cl.
*F17C 13/04* (2006.01)
*F17C 13/02* (2006.01)

(52) U.S. Cl.
CPC ..... *F17C 13/04* (2013.01); *F17C 13/025* (2013.01); *F17C 13/026* (2013.01); (Continued)

(58) Field of Classification Search
CPC ..... F17C 13/04; F17C 13/025; F17C 13/026; F17C 2201/0104; F17C 2205/0326; (Continued)

(56) References Cited

U.S. PATENT DOCUMENTS

2004/0200477 A1* 10/2004 Bleys ..... A61M 16/12 128/204.18
2008/0150739 A1 6/2008 Gamard
(Continued)

FOREIGN PATENT DOCUMENTS

DE 20 2017 102422 7/2018
EP 2848901 A1 * 3/2015 ..... G01F 1/86
(Continued)

OTHER PUBLICATIONS

WO2015110724A1—English Translation (Year: 2014).*
French Search Report for corresponding 2000287, dated Jul. 21, 2020.

*Primary Examiner* — Timothy L Maust
*Assistant Examiner* — Christopher M Afful
(74) *Attorney, Agent, or Firm* — Elwood L. Haynes

(57) ABSTRACT

The invention relates to a gas container equipped with a gas distribution valve having an electronic device for measuring gas autonomy. Flow selection means allow a desired gas flow to be selected. The electronic device includes a pressure sensor. Signal processing means allow gas autonomies to be determined on the basis of the pressure signal and of the selectable gas flows. A selection component cooperates with the signal processing means in order to successively display, on data display means and in response to successive digital activations by the user of the selection component, the various selectable flow values and the various corresponding autonomies, with each flow value being simultaneously displayed with a corresponding autonomy.

9 Claims, 2 Drawing Sheets

(52) U.S. Cl.
CPC ..... *F17C 2201/0104* (2013.01); *F17C 2205/0326* (2013.01); *F17C 2221/011* (2013.01); *F17C 2250/032* (2013.01); *F17C 2250/043* (2013.01); *F17C 2250/0439* (2013.01); *F17C 2250/0636* (2013.01); *F17C 2270/025* (2013.01)

(58) Field of Classification Search
CPC ..... F17C 2221/011; F17C 2250/032; F17C 2250/043; F17C 2250/0439; F17C 2250/0636; F17C 2270/025
USPC ..... 222/3
See application file for complete search history.

(56) References Cited

U.S. PATENT DOCUMENTS

| | | | | |
|---|---|---|---|---|
| 2010/0130917 | A1 | 5/2010 | Sezeur et al. | |
| 2012/0080103 | A1 | 4/2012 | Levine et al. | |
| 2012/0130304 | A1* | 5/2012 | Barish | A61M 13/003 604/24 |
| 2017/0114961 | A1 | 4/2017 | Baune et al. | |
| 2019/0162617 | A1 | 5/2019 | Quattrone | |

FOREIGN PATENT DOCUMENTS

| | | | | |
|---|---|---|---|---|
| EP | 2 937 620 | | 10/2015 | |
| EP | 2 940 370 | | 11/2015 | |
| EP | 3 002 498 | | 4/2016 | |
| EP | 3 006 810 | | 4/2016 | |
| EP | 3 421 866 | | 1/2019 | |
| FR | 2 908 048 | | 5/2008 | |
| WO | WO 2005 093377 | | 10/2005 | |
| WO | WO 2012 164240 | | 12/2012 | |
| WO | WO-2015110724 | A1 * | 7/2015 | F17C 13/025 |
| WO | WO 2016 066685 | | 5/2016 | |
| WO | WO 2017 165414 | | 9/2017 | |

* cited by examiner

GAS CONTAINER WITH DISPLAY OF THE FLOW AND OF THE CORRESPONDING AUTONOMY

CROSS REFERENCE TO RELATED APPLICATIONS

This application claims the benefit of priority under 35 U.S.C. § 119 (a) and (b) to French Patent Application No. 2000287, filed Jan. 14, 2020, the entire contents of which are incorporated herein by reference.

BACKGROUND

The invention relates to a gas container, such as a gas cylinder, for storing or distributing gas, which container is equipped with a gas distribution valve, which allows the gas to be delivered at various flows that can be selected by the user and on which an electronic device is mounted for measuring gas autonomy, which device comprises a display, such as a digital screen, for displaying gas flow and autonomy values.

Healthcare professionals working in hospital buildings, emergency units (ambulance services, fire response services, etc.) or others, for example, nurses, doctors, firefighters, etc. often use pressurized gas containers, in particular gas cylinders, in particular for medical gases, such as oxygen or medical air.

Such a gas container is generally equipped with a gas distribution valve usually comprising flow selection means to allow a user to select a desired gas flow and a gas outlet fitting or connection for delivering the gas at the desired flow that has been selected.

Advantageously, the gas distribution valve is protected by a protective cowling or cap forming a shell for protecting against impacts, dirt, etc. Such gas containers are, for example, disclosed in EP-A-3006810, EP-A-2940370, and EP-A-2937620.

A practical problem for users of gas cylinders or similar means is that they often have to select between several cylinders, which are stored, for example, in a depot or a response vehicle, as a function of the patient to be treated and of the prescription that they must administer to this patient, i.e. the gas flow (e.g. expressed in L/min) that they have to administer to them for a determined duration. For example, a patient may require 2 L/min of oxygen for a duration of 1 hour.

The user must select a gas cylinder to be used to treat a given patient so that the selected cylinder can be used for the entire desired treatment duration and at the selected flow, i.e. so as to follow the prescription raised for the patient to be treated.

However, the various gas cylinders do not all have the same gas capacity or content and/or the same amount of gas rarely remains in the various gas cylinders that are stored in the same location.

Currently, it is known for the gas autonomy of a gas container, such as a gas cylinder, to be estimated, i.e. to estimate the duration during which the gas container can continue to supply gas as a function of a flow selected by the user. The autonomy estimate is generally made using an electronic device comprising a pressure sensor, which is fixed to the gas distribution valve equipping the gas container and allows the pressure of the gas inside the container to be measured, then allows a pressure signal to be supplied to signal processing means, such as a microprocessor, used to compute the autonomy of the container on the basis of the supplied pressure signal and of the gas flow selected by the user. The computed autonomy is subsequently displayed on a screen or similar means borne by the electronic device. This is particularly disclosed in WO-A-2005/093377, EP-A-3440605 or EP-A-3421866.

The display screen can be a touchscreen, as taught in EP-A-3002498. Advantageously, the display screen is located in a high position to facilitate reading, as disclosed in EP-A-3117136.

However, this means that the user, who is hesitating between several gas cylinders, has to activate the flow selector of the valve of each cylinder in order to select the desired flow and has to wait until the autonomy displays on the display screens of the electronic devices of the various cylinders. These operations have to be repeated as many times as are necessary when several flows have to be assessed. In the end, the user has to remember all the information in order to select the most suitable gas cylinder.

In some cases, the user also has to make calculations, since some electronic devices display a remaining amount of gas that is expressed in litres, for example, and this does not allow the operating duration to be known without making a calculation taking into account the prescribed gas flow. However, it is understood that this is tedious and is the source of errors and therefore of risks for the patients, and can also cause the user to take up a lot of time, which they do not necessarily have, particularly when they have to respond in an emergency/quickly and/or treat several patients at the same time.

In this context, the problem that arises involves offering a user, typically a healthcare professional, the possibility of quickly and immediately knowing the autonomy of a gas container, typically a medical gas cylinder, equipped with a distribution valve and containing pressurized gas, i.e. compressed (i.e. >1 bar), for several different gas flows, without them having to make any calculations and/or manipulate the gas flow selector to select the various flows of interest to them from the plurality of possible flows, i.e. all the flows that can be supplied by the valve equipping the gas container.

SUMMARY

The solution according to the invention relates to a gas container, such as a gas cylinder, equipped with a gas distribution valve comprising, i.e. on which is mounted, an electronic device for measuring gas autonomy, wherein:

- the gas distribution valve comprises flow selection means allowing a user to select a desired gas flow from among a plurality of selectable gas flows; and
- the electronic device comprises:
  - at least one pressure sensor configured to measure the pressure of the gas contained in the container and to provide at least one pressure signal;
  - signal processing means configured to determine a plurality of gas autonomies at least on the basis of the pressure signal provided by said at least one pressure sensor and the plurality of selectable gas flows;
  - data display means configured to display a gas autonomy and a corresponding flow value; and
  - a digital activation selection component that can be activated by a user;

characterized in that the selection component is configured to cooperate with the signal processing means in order to successively display; on the data display means and in response to successive digital activations by the user of the selection component, the various selectable flow values and the various corresponding autonomies, each flow value being simultaneously displayed with a determined corresponding autonomy for said considered flow value.

In other words, according to the invention, in response to the successive digital activations by the user of the selection component, the data display means successively display the various selectable flow values and the various corresponding autonomies in the form of flow/autonomy pairs, with each flow/autonomy pair comprising a flow value and the corresponding autonomy that has been determined for the considered flow value.

By successively pressing the selection component, the user therefore scrolls through the various flow/autonomy pairs on the data display means that can be determined for the various possible selectable flows, for example, flow values ranging between 0 and 30 L/min.

It is to be noted that the gas autonomy values are expressed and/or displayed in the form of a possible operating duration, for example, in minutes or in hours and minutes.

Depending on the considered embodiment, the gas container of the invention can comprise one or more of the following features:

- the electronic device is configured to successively display the various flow/autonomy pairs, after successive presses on the selection component by the user, when it is in the inactive or passive state, i.e. when no gas flow exists;
- the selection component is configured to cooperate with the signal processing means so that successive digital activations by the user result in the various selectable flow values (Q) and the various corresponding autonomies (A) being scrolled through and displayed on the data display means;
- the data display means are configured to display an autonomy/flow pair comprising a flow value (Q) and a corresponding autonomy (A);
- the selectable gas flows (Q) range between 0 L/min and 30 L/min, preferably between 0 and 25 L/min;
- the selection component is configured to cooperate with the signal processing means so that the successive digital activations by the user of said selection component results in the flow/autonomy pairs being successively scrolled through and displayed in the increasing order of the flows. For example, for the following flow values, taken in the increasing order of the flows, namely 0.5, 1, 2, 3, 5, 8, 10, 12, 15, 20, 22 and 25 L/min, the first pair displayed following the first digital activation by the user includes the first selectable flow (e.g. 0.5 L/min), the second pair displayed following the second digital activation by the user includes the second selectable flow (e.g. 1 L/min), the third pair displayed following the third digital activation by the user includes the third selectable flow (e.g. 2 L/min), and so on up to the last selectable flow (e.g. 25 L/min in this case);
- the signal processing means are configured so that, only after displaying the last flow/autonomy pair including the maximum selectable flow (i.e. last selectable flow), for example, in this case the maximum flow of 25 L/min, an additional digital activation by the user of the selection component results in the display means redisplaying the first flow/autonomy pair including the minimum selectable flow (e.g. 0.5 L/min), i.e. scrolling through occurs as a loop;
- the signal processing means are configured so that, only after suspending or stopping the digital activation by the user of the activation component (e.g. button or similar means) for a given duration, for example, a duration above or equal to 3 seconds, typically between 3 and 20 seconds, for example, between 5 and 10 seconds, the display of the flow/autonomy pairs is reset so that any new digital activation by the user of the activation component results in the display means displaying the first flow/autonomy pair including the minimum selectable flow (e.g. 0.5 L/min);
- the data display means comprise a display screen;
- the electronic device comprises an external casing supporting the data display means and containing the signal processing means;
- the gas distribution valve further comprises a gas outlet fitting for delivering the gas at the desired gas flow selected by said flow selection means;
- the signal processing means comprise at least one microprocessor, preferably a microcontroller;
- the digital activation selection component comprises a key, a selection button or similar means;
- the container is a pressurized gas cylinder, i.e. a gas canister;
- the container comprises a container body defining an internal volume or compartment containing a gas or compressed gaseous mixture, i.e. pressurized 1 atm);
- the container body comprises an internal volume with a volume that is less than or equal to 50 L (water equivalent);
- the container body is cylindrical shaped, preferably in the shape of an ogive;
- the container body comprises a neck comprising an outlet orifice in fluid communication with the internal volume;
- the gas distribution valve is fixed to the neck of the container body;
- the neck of the container body is made of metal material (s), in particular of steel or aluminium alloy, or of composite material(s);
- the gas or gaseous mixture stored in the internal volume of the gas container is oxygen, air, an $NO/N_2$ mixture, an $He/O_2$, $O_2/N_2O$ mixture or any other gas, in particular any other medical gas;
- the gas distribution valve comprises integrated gas expansion means, i.e. it is an integrated expansion valve (IEV);
- the gas expansion means comprise an expansion valve and a valve seat;
- the gas or gaseous mixture is compressed to a pressure that is less than or equal to 350 bar abs, typically less than 300 bar abs;
- the gas distribution valve is made of copper alloy, in particular of brass, or of steel, or both;
- the flow selection means allow a user to select a desired gas flow from a plurality of selectable gas flows ranging between 0 L/min and 30 L/min, preferably between 0.5 L/min and 25 L/min;
- the flow selection means allow a desired gas flow to be selected from 5 to 30 different gas flows, preferably between 8 and 25 different gas flows, for example, from 10 to 20 different gas flows;
- the flow selection means allow a desired gas flow to be selected from a plurality of selectable gas flows comprising at least some of the following flow values: 0.5, 1, 1.5, 2, 3, 4, 5, 6, 7, 8, 9, 10, 12, 15, 20, 22 and 25 L/min;

it comprises storage means, such as a flash memory or other means, allowing the plurality of flow and/or pressure values to be stored;

the flow selection means comprise a rotary flow selector that can be manipulated/activated by the user;

the rotary flow selector is of the rotary handwheel type;

the signal processing means comprise an electronic board;

preferably, the electronic board supports at least one microprocessor, preferably a microcontroller;

the microprocessor uses at least one algorithm;

advantageously, the electronic board also supports said at least one pressure sensor used to measure the pressure of the gas inside the container;

advantageously, the electronic board further comprises said at least one temperature sensor used to measure the ambient and/or the gas temperature and to supply at least one temperature signal;

the electronic device comprises a gas temperature sensor for measuring the temperature of the gas, i.e. configured to determine the temperature of the gas contained in the pressurized gas container;

the electronic device comprises an ambient temperature sensor for measuring the ambient temperature, i.e. configured to determine the temperature of the environment (i.e. air) located around the electronic device or in the casing of said electronic device;

the electronic device also comprises a position sensor for determining the position of the flow selection means, i.e. configured to determine the gas flow selected by the user by determining the angular position of a rotary selector, such as a rotary handwheel;

the pressure sensor is coupled to the gas temperature sensor so as to supply at least one gas pressure signal that is correlated to, associated with or corresponds to a gas temperature measured when the pressure measurement is taken;

the pressure sensor is associated with a gas temperature sensor in order to supply the signal processing means with a pressure signal corresponding to or associated with a measured gas temperature;

the signal processing means are configured to determine a gas autonomy on the basis of said at least one pressure signal supplied by the pressure sensor, of at least one gas temperature signal supplied by the gas temperature sensor, of at least one ambient temperature signal supplied by the ambient temperature sensor and of at least one gas flow corresponding to a position of the flow selector;

the gas valve comprises a valve body through which a gas circuit passes, i.e. one or more gas pipes;

the gas circuit fluidly connects the internal volume of the gas container to the gas outlet connection, i.e. the gas outlet fitting used to supply the gas;

the gas expansion means are arranged on the gas circuit;

said at least one pressure sensor is connected to the gas circuit upstream of said gas expansion means, i.e. in the portion of the gas circuit that experiences the high gas pressure since it is in fluid communication with the internal volume of the container;

said at least one pressure sensor is configured to measure the pressure of the gas contained in the container via a pressure connection provided on the gas circuit in the portion of the gas circuit that experiences the high gas pressure;

the microprocessor, typically a microcontroller, uses at least one algorithm for computing one or more gas autonomies on the basis of pressure, gas temperature, ambient temperature measurement signals and of one or more values representing the position of the flow selector;

the data display means comprise a digital screen, for example, an LED, liquid crystal (LCD), segment or other screen;

the electronic device comprises an external casing supporting the data display means, preferably a built-in screen in one of the walls of said casing, typically the upper wall of said external casing;

the data display means are electrically connected to the signal processing means;

the electronic device comprises an external casing containing the signal processing means;

it comprises electric current supply means that are directly or indirectly electrically connected to the signal processing means, to at least one sensor and/or to the display means for directly or indirectly supplying them with electric current;

the electric current supply means comprise one (or more) electric cells or batteries, preferably with electric autonomy of at least 2 years, preferably at least 5 years, ideally approximately 10 years;

the external casing is made of rigid material, preferably of metal or of polymer;

the external casing forms a frame protecting the components located therein, such as the signal processing means, the one or more sensors, the electric current supply means, etc.;

the displayed gas flow values are preferably expressed in L/min;

the autonomy is preferably expressed in hours and minutes or in minutes;

the autonomy displayed for each selectable flow is a duration, i.e. estimated operating time;

the gas autonomy values and the corresponding gas flow values are displayed in the form of pairs of autonomy/flow values;

the gas distribution valve is protected by a cowling or a protective cap forming a shell for protecting against impacts, dirt, etc., preferably made of polymer or of metal or metal alloy;

the protective cowling comprises at least one carrying handle and/or a system for attaching to a support, in particular a hospital bed rail or similar means;

the electronic device for measuring gas autonomy is fixed to the valve and the protective cowling comprises at least one opening, in which the electronic device is housed.

The invention also relates to the use of the gas container according to the invention, typically a gas cylinder, for storing or distributing gas, in particular medical gases, such as oxygen, air, an $NO/N_2$ mixture, an $He/O_2$, $O_2/N_2O$ mixture or other.

Furthermore, the invention also relates to a patient ventilation assembly comprising a gas container, such as a gas cylinder, according to the invention, a breathing interface for supplying the gas to a patient, and a flexible pipe connecting said container to said breathing interface. Preferably, the breathing interface is a breathing mask or similar means.

BRIEF DESCRIPTION OF THE DRAWINGS

The invention will now be better understood from the following detailed description, which is provided by way of a non-limiting illustration, with reference to the appended figures, in which.

DETAILED DESCRIPTION OF THE PREFERRED EMBODIMENTS

Figure 1:
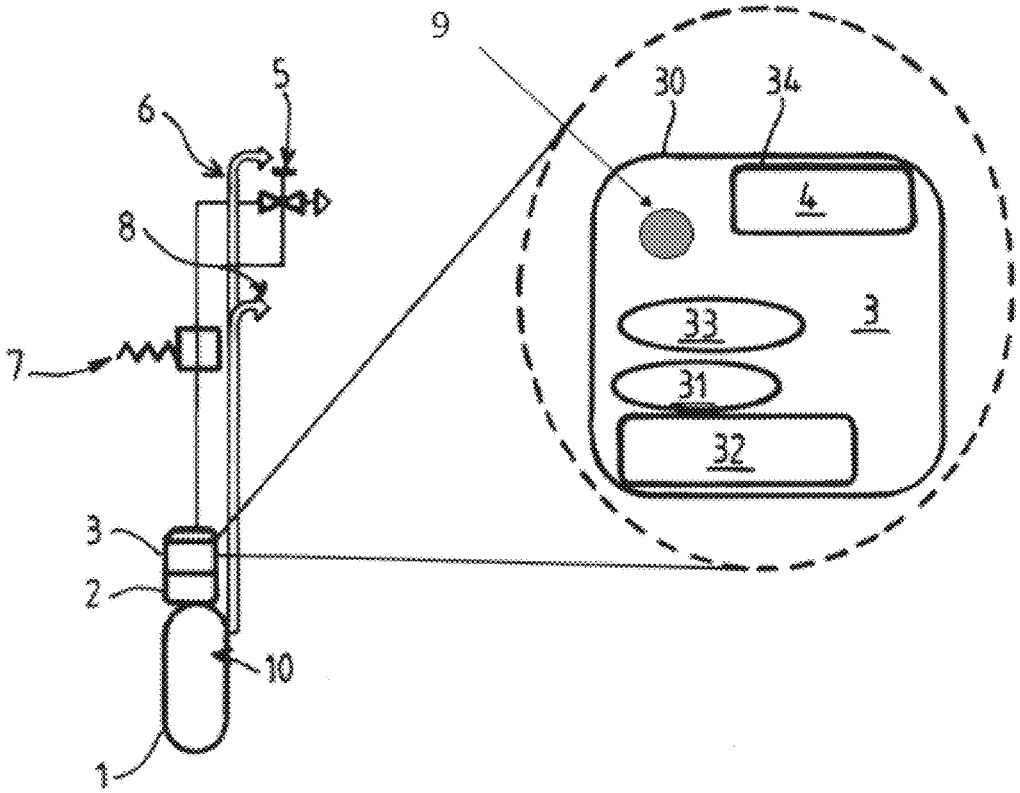
FIG. 1 schematically shows an embodiment of a gas container according to one embodiment of the present invention.

FIG. 1 schematically shows an embodiment of a gas container 1 according to the invention, namely in this case a gas cylinder or canister with a cylindrical body made of steel or aluminium alloy, equipped with a gas distribution valve 2, also called valve, on which an electronic device 3 is mounted for displaying the gas autonomy and flow comprising data display means 34, for example, a digital screen 4, for example, of the segment LCD type.

The gas distribution valve 2 comprises a brass body, for example, through which an internal gas circuit passes, i.e. one or more gas passages, pipes or channels, in fluid communication with the internal volume 10 of the gas container 1.

The gas distribution valve 2 comprises flow selection means 5, namely in this case a rotary handwheel or similar means, allowing a user, such as a healthcare professional, to select a desired gas flow from among a plurality of selectable gas flows, preferably a dozen possible flows ranging between 0 and 25 L/min, for example, the following flows: 0.5, 1, 2, 3, 5, 8, 10, 12, 15, 20, 22 and 25 L/min. The user is supplied with the gas flow through a gas outlet connection or fitting 6, i.e. an adaptor or similar means.

A second gas outlet connection 8, called notched connection, also can be provided that allows specific fluid connection of a ventilation apparatus or similar means, for example.

Furthermore, the gas distribution valve 2 also comprises integrated gas expansion means 7, i.e. it is an integrated expansion valve (IEV) 2, allowing the gas pressure to be reduced from its pressure, called high pressure, typically a pressure that can reach 350 bar abs, inside the volume or internal compartment 10 of the gas container 1 to its operating pressure, called low pressure, which generally is less than 10 bar abs, for example, of the order of 4 bar abs or less.

The gas expansion means 7 usually comprise an expansion valve and a valve seat (not shown) cooperating with each other in order to reduce the gas pressure.

The gas expansion means 7 are arranged on the internal gas circuit, i.e. one or more gas passages, pipes or channels, passing through the valve body 2 and fluidly connecting the internal volume 10 of the gas container 1 and the gas outlet connection 6 used to deliver the gas at the desired gas flow selected by the user by activating the flow selection means 5.

The portion of the gas circuit located upstream of the gas expansion means 7 experiences the high pressure, i.e. the pressure prevailing in the internal volume 10 of the container 1, whereas the portion located downstream of the gas expansion means 7 experiences the low pressure, i.e. the gas pressure following expansion.

The electronic device 3 comprises, for its part, a pressure sensor 31 used to measure the pressure of the gas inside the container 1 and to supply at least one pressure signal, and signal processing means 32, such as an electronic board with microcontroller, for determining at least one gas autonomy on the basis of the pressure signals provided by the pressure sensor 31 and at least one gas flow, and preferably a temperature measured by a temperature sensor 33 arranged so as to measure the ambient temperature, i.e. the environment around the device 3 and/or a temperature inside the device 3. Indeed, the temperature inside the device 3 corresponds to the ambient temperature and its variations reflect the variations of the ambient temperature, i.e. the ambient air.

Preferably, the pressure sensor 31 is coupled to the gas temperature sensor so as to provide at least one gas pressure signal that is correlated to, associated with or corresponds to a gas temperature measured when the pressure measurement is taken.

The electronic device 3 also comprises a position sensor for determining the position of the flow selection means 5, typically a rotary selector, i.e. the position sensor is configured to determine the gas flow selected by the user by determining the angular position of the rotary selector, such as a rotary handwheel.

The pressure sensor 31 is preferably connected to the portion of the gas circuit of the valve body that is located upstream of the gas expansion means 7, which experiences the high gaseous pressure. Preferably, the pressure sensor 31 comprises, or is associated with, an integrated gas temperature sensor allowing a pressure signal to be provided that relates to the temperature of the gas that is measured when the pressure measurement is taken.

Preferably, the pressure sensor 31 and the signal processing means 32, such as an electronic board with microcontroller, are arranged in a rigid casing 30, for example, made of polymer or of metal.

Data display means 34, such as a digital screen 4, are also provided that allow information useful to the user to be displayed, in particular the gas autonomy computed by the signal processing means 32 and the corresponding gas flow, as explained hereafter.

The digital screen 4 is supported by the rigid casing 30. Electric current supply means are also provided that are directly or indirectly electrically connected to the various components that require electricity to operate, in particular to the signal processing means 32, to the sensors 31, 33, to the display means 34 of the rigid casing 30, so as to directly or indirectly supply them with electric current and thus allow them to operate. Advantageously, the electric current supply means comprise an electric cell, advantageously having electric autonomy of at least 5 years, ideally of approximately 10 years.

The signal processing means 32 are configured to determine gas autonomies on the basis of the pressure signal supplied by the pressure sensor 31 and of the plurality of selectable gas flows, and preferably also of the measured temperatures, for example, the ambient and/or gas temperature.

In other words, the signal processing means 32 determine flow/autonomy pairs at least on the basis of the pressure signal and of the various possible flows, preferably ranging between 0 and 25 L/min, for example, the following flows: 0.5, 1, 2, 3, 5, 8, 10, 12, 15, 20, 22 and 25 L/min. A given autonomy corresponds to each flow, which autonomy is computed on the basis of said flow and of the measured gas pressure, or even on the basis of one or more parameters (i.e. temperatures, etc.).

According to the present invention, a digital activation selection component 9, such as a button or a key, that can be activated by a user is also provided. This selection component 9 is preferably arranged next to the screen 4 of the data display means 34, as illustrated in FIG. 1 to FIG. 3.

Figure 2:
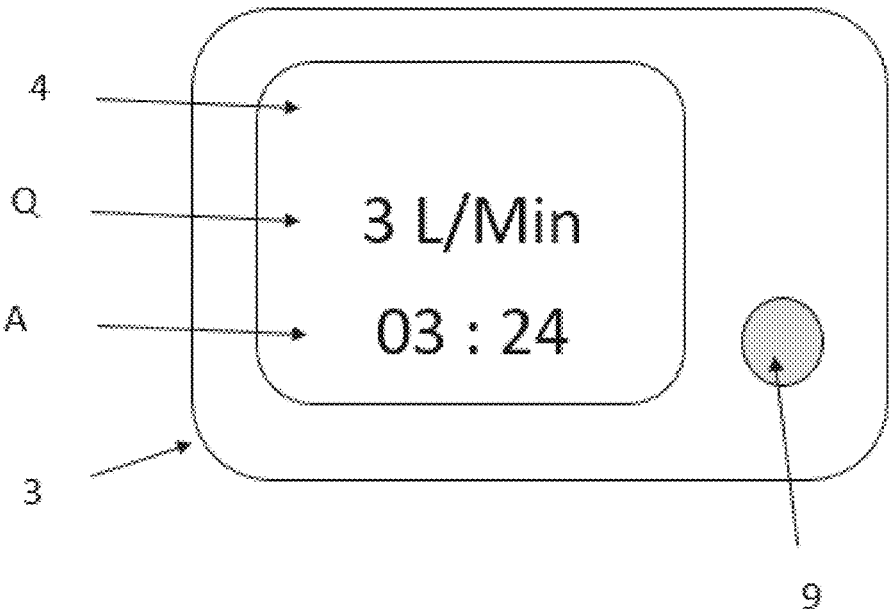
FIG. 2 illustrates the display of a first gas autonomy/flow pair according to one embodiment of the present invention.
Figure 3:
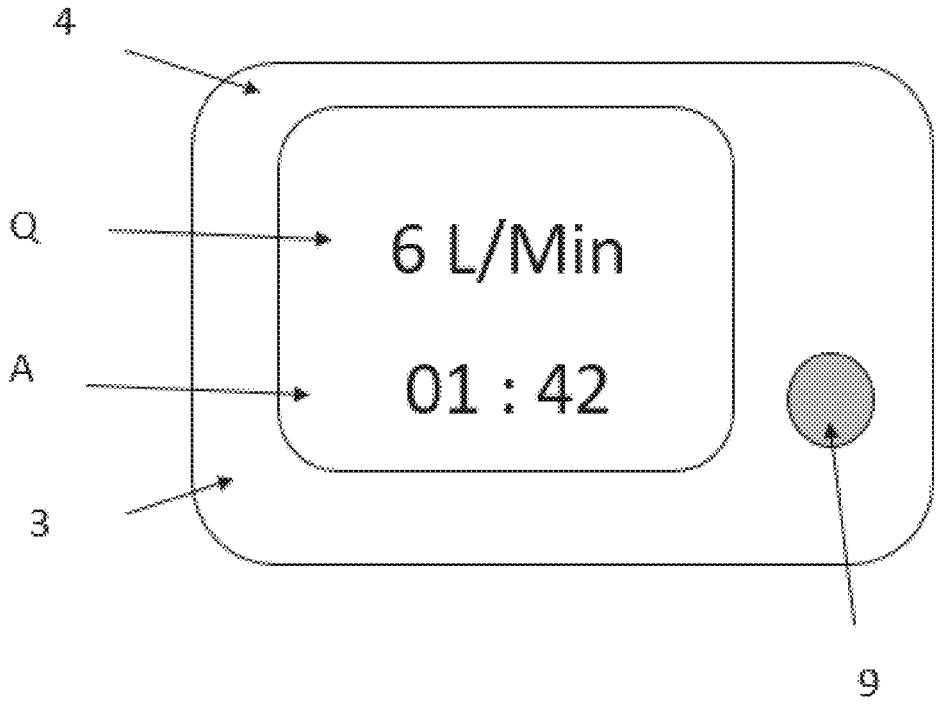
FIG. 3 illustrates the display of a second gas autonomy/flow pair according to one embodiment of the present invention.

More specifically, the selection component 9, i.e. a button or similar means, is configured to cooperate with the signal processing means 32 and the data display means 34 for successively displaying, i.e. scrolling through, in response to successive digital activations by the user of the selection component 9, the various selectable flow values and the various corresponding autonomies, with each flow value being displayed simultaneously with a corresponding autonomy determined for said considered flow value, i.e. the screen 4 successively displays autonomy/flow pairs, as illustrated in FIG. 2 and FIG. 3.

In other words, the signal processing means 32 allow the gas autonomy to be estimated, i.e. the possible operating duration of the container 1, for each flow that can be selected by the flow selection means 5 and the pressure of the measured gas. These pairs comprising an estimated autonomy and a corresponding gas flow are then successively displayed on the screen 4 when the user presses the selection component 9, i.e. a button or similar means, several times, i.e. when the user scrolls through the various autonomy/flow pairs obtained for the measured gas pressure, or even other data, such as one or more temperatures.

To this end, the signal processing means 32 comprise an electronic board with microprocessor(s) receiving measurement signals from the pressure sensor 31 and from the gas temperature sensor associated therewith, and from the ambient temperature or equivalent temperature sensor 33, when the container 1 is used. These pressure and temperature measurement signals are processed by one or more algorithms used by the one or more microprocessor(s) of the electronic board.

The gas autonomy is expressed in possible operating times, typically in hours and minutes or simply in minutes.

In general, the determined gas autonomy (A) and the corresponding gas flow value (Q) are displayed in pairs, as illustrated in FIG. 2 and FIG. 3.

In other words, by pressing the button 9 several times in succession the user obtains a display on the screen 4, successively with all the possible autonomy values (A) associated with all the corresponding gas flows (Q) that scroll through in autonomy/flow pairs on the screen 4 following the digital activations, i.e. successive presses, of the button 9 by the user.

Thus, a member of personnel wishing to use a gas cylinder 1 is able to select the cylinder most suitable for them, without having to perform a calculation or complicated manipulations, but simply by scrolling through the various autonomy/flow pairs corresponding to the measured gas pressure.

In the embodiment of FIG. 2 and FIG. 3, the flow and the autonomy are displayed one above the other on the screen 4; however, they also can be displayed side-by-side, or otherwise.

Preferably, the flow/autonomy pairs are successively displayed by taking the flows in their increasing order, i.e. the lowest flow, for example, 0.5 L/min, is displayed initially, then the other flows are displayed in increasing order, during the various activations of the button 9 by the user, for example, 1, then 2, then 3, etc. and, finally, 25 L/min, using the example provided above.

Preferably, when the user stops pressing the button 9, the scrolling through resets after a given delay, for example, after a few seconds, for example, after 3 seconds to 10 seconds. Pressing the button 9 again, after this given delay, will redisplay the flow/autonomy pair for the lowest selectable flow.

The gas autonomies (A) relative to the possible flows (Q) can be computed as follows on the basis of the gas pressure in the container 1 measured by the pressure sensor 31. This pressure can be understood to be an available gas volume by virtue of Gay Lussac's law:

$$P_{atm}V_{gaz}=P_{gaz}V_{cyl}$$

where:

$P_{atm}$ denotes the atmospheric pressure (i.e. 1 bar abs=1 atm);

$V_{gas}$ denotes the volume of available gas;

$P_{gas}$ denotes the gas pressure in the container, i.e. high pressure;

$V_{cyl}$ denotes the internal volume of the gas container.

The volume of available gas is then;

$$V_{gas} = \frac{P_{gas}V_{cyl}}{P_{atm}}$$

$P_{gas}$ is computed on the basis of the direct measurements performed by the pressure sensor 31 and a temperature sensor 33, which allow a gas pressure value to be estimated.

For each flow Q, it is then possible to compute a corresponding gas autonomy A, as illustrated in Table 1 for the 12 aforementioned flows (Q).

TABLE 1

| Selectable flows (Q) | Autonomy (A) according to the volume of gas available in the container |
|---|---|
| 0.5 L/min | $Autonomy_{0.5\ L/min} = \frac{V_{gas}}{0.5\ L/min}$ |
| 1 L/min | $Autonomy_{1\ L/min} = \frac{V_{gas}}{1\ L/min}$ |
| 2 L/min | $Autonomy_{2\ L/min} = \frac{V_{gas}}{2\ L/min}$ |
| 3 L/min | $Autonomy_{3\ L/min} = \frac{V_{gas}}{3\ L/min}$ |
| 5 L/min | $Autonomy_{5\ L/min} = \frac{V_{gas}}{5\ L/min}$ |
| 8 L/min | $Autonomy_{8\ L/min} = \frac{V_{gas}}{8\ L/min}$ |
| 10 L/min | $Autonomy_{10\ L/min} = \frac{V_{gas}}{10\ L/min}$ |
| 12 L/min | $Autonomy_{12\ L/min} = \frac{V_{gas}}{12\ L/min}$ |
| 15 L/min | $Autonomy_{15\ L/min} = \frac{V_{gas}}{15\ L/min}$ |

TABLE 1-continued

| Selectable flows (Q) | Autonomy (A) according to the volume of gas available in the container |
|---|---|
| 20 L/min | $Autonomy_{20\ L/min} = \frac{V_{gas}}{20\ L/min}$ |
| 22 L/min | $Autonomy_{22\ L/min} = \frac{V_{gas}}{22\ L/min}$ |
| 25 L/min | $Autonomy_{25\ L/min} = \frac{V_{gas}}{25\ L/min}$ |

EXAMPLE

A given patient requires a prescription of 2 L/min of oxygen for 30 minutes.

A user, i.e. a healthcare professional, thus must provide them with this gas according to the medical prescription relating to this patient. To this end, they have two gas cylinders 1 comprising different amounts of oxygen, namely 200 L for one and 1000 L for the other, but different gas pressures. For example, in the case of a cylinder:

of the B10 type (i.e. containing 10 L of water equivalent), 200 L of gas corresponds to a pressure of the order of 20 bar abs, whereas 1000 L of gas corresponds to a pressure of the order of 100 bar abs;

of the B5 type (i.e. containing 5 L of water equivalent), 200 L of gas corresponds to a pressure of the order of 40 bar abs, whereas 1000 L of gas corresponds to a pressure of the order of 200 bar abs;

Each cylinder 1 is equipped with an electronic device 3 for measuring gas autonomy comprising a display screen 4 according to the invention, as schematically shown in FIG. 1.

In this passive state, the user sees, in order to make their selection, either the amount of available gas in litres, or the gas pressure, as appropriate, that is displayed on the electronic device 3 of each gas cylinder 1. In another embodiment, both, i.e. amount (in L) and pressure (in bar), can be displayed.

However, in both cases the user, such as a healthcare professional, cannot know for how long and at which flow each cylinder 1 can be used.

By virtue of the electronic device equipping the gas cylinders 1 according to the present invention, the user can easily determine which cylinder can be used for how long and at which flow by simply pressing the button 9 several times in succession in order to scroll through the various flow/autonomy pairs, which are then displayed, one after the other, on the screen 4 of the electronic device 3, as schematically shown in FIG. 2 and FIG. 3.

Thus, the flow/autonomy pairs that the user can scroll through by activating the button 9 and that are then successively displayed on the screen 4 of each gas cylinder are, for example, those provided in Table 2 below.

TABLE 2

| Flow/autonomy pairs displayed on the screen of a cylinder containing 1000 L | | Flow/autonomy pairs displayed on the screen of a cylinder containing 200 L | |
|---|---|---|---|
| 0.5 L/min | 2000 min | 0.5 L/min | 400 min |
| 1 L/min | 1000 min | 1 L/min | 200 min |
| 2 L/min | 500 min | 2 L/min | 100 min |

TABLE 2-continued

| Flow/autonomy pairs displayed on the screen of a cylinder containing 1000 L | | Flow/autonomy pairs displayed on the screen of a cylinder containing 200 L | |
|---|---|---|---|
| 3 L/min | 333 min | 3 L/min | 67 min |
| 5 L/min | 200 min | 5 L/min | 40 min |
| 8 L/min | 125 min | 8 L/min | 25 min |
| 10 L/min | 100 min | 10 L/min | 20 min |
| 12 L/min | 83 min | 12 L/min | 17 min |
| 15 L/min | 67 min | 15 L/min | 13 min |
| 20 L/min | 50 min | 20 L/min | 10 min |
| 22 L/min | 45 min | 22 L/min | 9 min |
| 25 L/min | 40 min | 25 L/min | 8 min |

In Table 2 the durations are displayed in minutes. However, these durations also can be displayed in hours and in minutes.

Thus, the user can quickly and immediately know the autonomy of each gas container, i.e. each medical gas cylinder 1, for the various possible gas flows, and can do so without having to perform any calculation and/or having to manipulate the gas flow selector to select the various flows of interest to them from the plurality of possible flows.

They can then decide which cylinder 1 can be used to treat the considered patient, in particular as a function of the prescription to be applied.

The pressurized gas container, in particular a gas cylinder, according to the invention is particularly adapted to be used for storing and/or distributing medical quality gas, namely a pure gas or a gaseous mixture.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A gas container equipped with a gas distribution valve comprising an electronic device for measuring gas autonomy, wherein:

the gas distribution valve comprises a flow selection means configured to allow a user to select a desired gas flow from among a plurality of selectable gas flows; and the electronic device comprises:

at least one pressure sensor configured to measure the pressure of the gas contained in the container and to provide at least one pressure signal;

a signal processing means configured to determine a plurality of gas autonomies at least on the basis of the pressure signal provided by said at least one pressure sensor and the plurality of selectable gas flows;

a data display means configured to display an autonomy and a corresponding flow value; and a digital activation selection component that can be activated by a user;

wherein the digital activation selection component is configured to cooperate with the signal processing means in order to successively display, on the data display means and in response to successive digital activations by the user of the digital activation selection component, the various selectable flow values and the various corresponding autonomies, each flow value being simultaneously displayed with a determined corresponding autonomy for said considered flow value.

2. The gas container according to claim 1, wherein the digital activation selection component is configured to cooperate with the signal processing means so that successive digital activations by the user result in the various selectable flow values and the various corresponding autonomies being scrolled through and displayed on the data display means are configured to display an autonomy/flow pair comprising a flow value and a corresponding autonomy.

3. The gas container according to claim 1, wherein the selectable gas flows range between 0 L/min and 30 L/min.

4. The gas container according to claim 1, wherein the electronic device further comprises:

a gas temperature sensor for measuring the gas temperature;

an ambient temperature sensor for measuring the ambient temperature; and/or a position sensor for determining the position of the flow selection means.

5. The gas container according to claim 1, wherein the data display means comprise a display screen.

6. The gas container according to claim 1, wherein the digital activation selection component is configured to cooperate with the signal processing means so that the successive digital activations by the user of said digital activation selection component result in the flow/autonomy pairs being successively scrolled through and displayed in the increasing order of the flows.

7. The gas container according to claim 1, wherein the signal processing means are configured so that, only after displaying the last flow/autonomy pair including the maximum selectable flow, an additional digital activation by the user of the digital activation selection component results in the display means redisplaying the first flow/autonomy pair including the minimum selectable flow.

8. The gas container according to claim 1, wherein the signal processing means are configured so that, only after suspending or stopping the digital activation by the user of the activation component for a given duration, the display of the flow/autonomy pairs is reset so that any new digital activation by the user of the activation component results in the display means displaying the first flow/autonomy pair including the minimum selectable flow.

9. The gas container according claim 1, wherein the digital activation selection component comprises a key or a selection button.

* * * * *